United States Patent [19]

Quarve et al.

[11] 4,000,856

[45] Jan. 4, 1977

[54] FOG/SPRAY SYSTEM AND APPARATUS

[75] Inventors: Vernon K. Quarve, Minneapolis; William Vork, Edina, both of Minn.

[73] Assignee: Graco Inc., Minneapolis, Minn.

[22] Filed: Sept. 2, 1975

[21] Appl. No.: 609,244

[52] U.S. Cl. ..... 239/332; 137/87; 222/334; 239/412

[51] Int. Cl.[2] ..... B05B 7/12

[58] Field of Search ..... 239/302, 332, 61, 390, 239/412, 415; 137/87; 222/334

[56] References Cited

UNITED STATES PATENTS

| | | | |
|---|---|---|---|
| 2,687,739 | 8/1954 | Shelburne et al. | 239/332 X |
| 2,779,627 | 1/1957 | Gray | 239/332 |
| 3,202,363 | 8/1965 | Kautz et al. | 239/412 X |
| 3,208,673 | 9/1965 | Kautz | 239/390 X |
| 3,322,351 | 5/1967 | Hackel | 239/61 X |
| 3,674,209 | 7/1972 | Liedberg | 239/412 X |

*Primary Examiner*—Evon C. Blunk
*Assistant Examiner*—Michael Mar
*Attorney, Agent, or Firm*—Paul L. Sjoquist

[57] ABSTRACT

Apparatus for producing a fog/spray as a coating medium for articles. The apparatus comprises a trigger actuated gun having an inlet connected to a source of hydraulically pressurized spray fluid, wherein the pressurizing medium and drive source is itself driven by a compressible fluid such as air. The compressible fluid supply line to the drive source has mounted therein a flow sensing valve which actuates an air valve for controlling atomizing air supply to the applicator gun. The atomizing air supply to the applicator gun is coupled into a gun chamber downstream of the spray orifice so that fluid sprayed through the orifice becomes fogged by the pressurized air in the chamber.

9 Claims, 3 Drawing Figures

FIG. 1
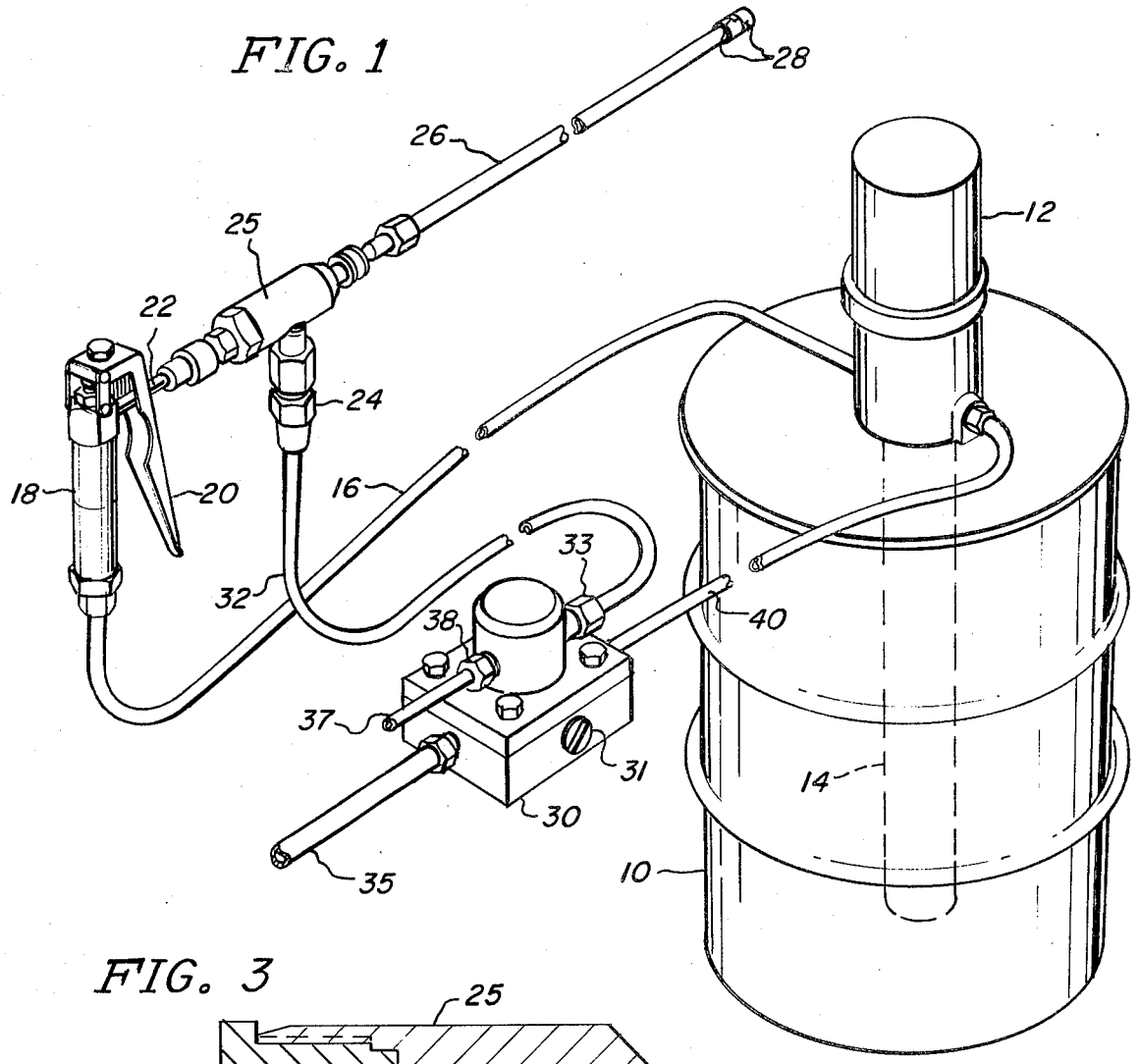
FIG. 3
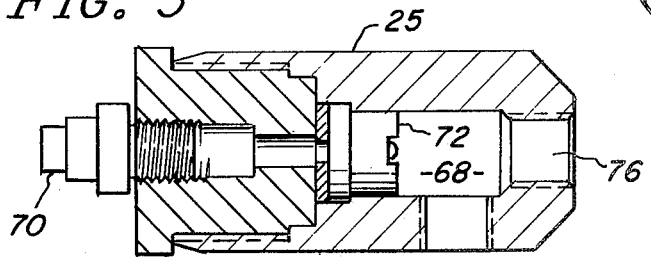
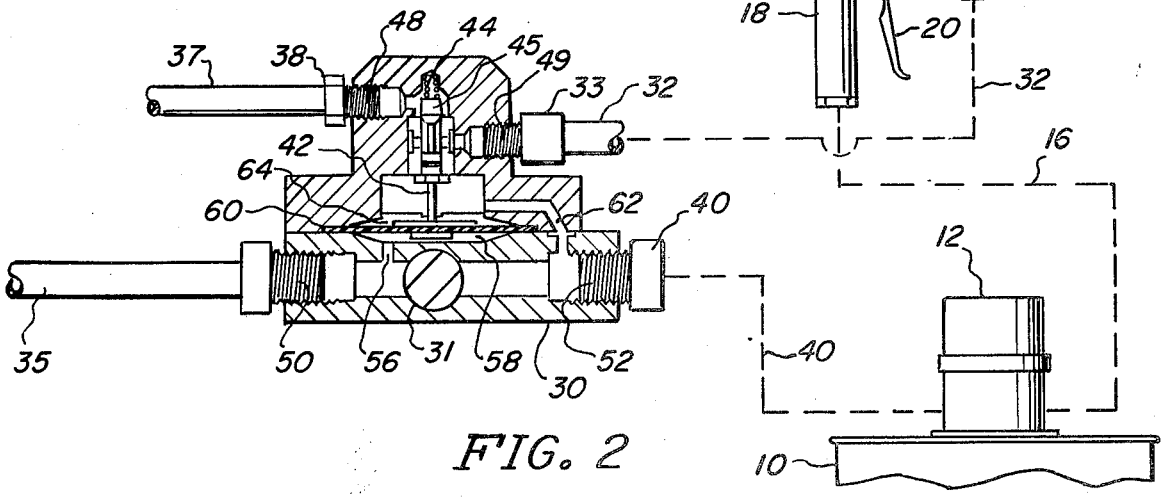
FIG. 2

FOG/SPRAY SYSTEM AND APPARATUS

BACKGROUND OF THE INVENTION

This invention relates to an apparatus for applying coatings to articles, and more particularly for applying a fog/spray to article surfaces which, because of inaccessibility, cannot otherwise be conveniently coated. For example, in the automobile industry the exterior surfaces of automobile bodies and frames may be readily coated using spray painting techniques which are well known in the art. However, automobile body members have a relatively large number of interior recesses which are inaccessible to the usual type of spray applicators, and which require special techniques if a complete and uniform coating is to be applied over all interior surfaces.

In general, there are two approaches to applying coatings to the surfaces of articles by means of spraying: hydraulic (airless) spraying, and air atomization (air) spraying. These two spraying techniques use basically different approaches for the atomization of the fluid being sprayed. In an airless spraying technique the fluid to be sprayed is placed under high hydraulic pressure, usually well in excess of 100 pounds per square inch (psi), and the pressurized fluid is forced through a very small orifice. The result is that the fluid particles atomize into very fine droplets and may be sprayed in this manner. Air spray techniques also utilize a very small orifice, but the fluid to be sprayed is pressurized at relatively low pressure, i.e., under 100 psi, in being forced through the orifice. Exterior to the orifice, a pressurized air stream is directed toward the emitted fluid particles and this pressurized air causes the particles to further atomize and thereby provides the desired degree of atomization for spraying.

The present invention utilizes the combination of these techniques to provide a fog/spray, wherein the fluid particles are very finely atomized into a mist or fog which may be ejected into an enclosed recess so as to settle over all interior surface areas of the recess. Conventional spraying techniques utilize apparatus for developing a spray pattern of predetermined shape, whereas the present invention is primarily concerned with the production of a fog and does not utilize a spray pattern except to the extent that the directional output of the fog may be controlled through suitable openings.

Because fog/spray devices are most useful for the application of coatings to interior and hard to reach recesses, they usually require an elongated tubular spray nozzle having end openings which can be inserted deep into interior recesses. The use of these elongated tubular applicators presents special problems to the aforementioned two types of conventional spraying. The technique of airless spraying would require the placement of an atomization spray tip at the end of this long applicator, and would therefore require that the applicator be sufficiently strong to withstand the dangerous high fluid pressures necessary in this technique. Because of space constraints, the fluid valve which would control the pressurized fluid emitted into the applicator must be placed at the opposite end of the applicator. This results in a column of fluid being held in the applicator between the fluid valve and spray tip, and causes the spray tip to emit droplets of fluid after the valve is shut off. This well known phenomenon is called "spitting," and occurs any time a pressurized fluid reservoir is permitted to be developed between the fluid valve and the spray tip. Air spray techniques cannot be used with an elongated applicator because air spray requires both air and fluid to be supplied to the end of the applicator. This would require a bulky air delivery and valving system which would restrict the use of the device to only larger recesses. If the air stream was coupled into the opposite end of the wand the air pressure used for atomization would not be enough to also convey the atomized spray through the wand. If the air pressure were increased, a condition would soon be reached whereby the atomization air pressure would exceed the fluid pressure and would impede fluid atomization. Thus, the present invention utilizes air pressures for ait atomization which exceed the pressures usually used in the prior art for this purpose (20–50 psi), and utilizes hydraulic fluid pressures in combination therewith which exceed the hydraulic fluid pressures usually used with air spray devices, but are lower than the hydraulic pressures usually used with airless spray devices (700–1000 psi).

Fog/spray devices are known in the prior art, as evidenced by the disclosure of U.S. Pat. No. 3,202,363, issued Aug. 24, 1965. This patent discloses a fog/spray device having a spray applicator gun with an interior chamber and valving arrangement to permit the mixing of pressurized fluid and air to create a fog. The patent disclosure describes a piston valve which is actuated by hydraulic fluid pressure working against a compression spring, and which lifts a poppet valve from its seat to admit air into a chamber surrounding the atomization spray tip. The pressurized air combines with the atomized fluid to create a fog which is transported through an elongated wand to the interior surface to be coated. As compared to this prior art patent, the present invention utilizes a novel approach for controlling the valving and mixing of the pressurized air in combination with the atomized fluid.

SUMMARY OF THE INVENTION

The present invention utilizes a reciprocating motor drive source, preferably an air motor, to provide pressurized coating fluid to an applicator gun. The applicator gun has a fluid valve which emits the fluid through an orifice into a fogging chamber, which chamber has an entry port for pressurized air. The air motor and fogging chamber pressurized air are derived from respective compressed air sources, which are fed through a novel control valve for controlling the application of atomizing air in response to the delivery of pressurized fluid as indicated by the operation of the air motor drive source. The control valve has a first flow-sensor section for detecting air flow needed to drive the air motor, which is detected by means of a differential pressure across a movable diaphragm. The diaphragm is connected to a second air control valve section to cause an air valve to lift from its seat when air flow exists in the first section. The second valve section is connected to the fogging chamber of the applicator gun to provide a source of compressed air for fogging. When the applicator trigger is released, hydraulic fluid flow ceases immediately, and shortly thereafter the air motor, sensing a blocked pressure in its pump delivery lines, ceases reciprocating and thereby stops the air flow through the control valve. This causes the diaphragm sensor to react, shutting off the air valve controlling pressurized air flow to the fogging chamber. The time delay required for such valve action permits pressurized air to flow into the fogging chamber for a predetermined time after the fluid flow has been shut off, which allows the pressurized air to purge the fogging chamber and elongated applicator wand of any remaining accumulations of fluid.

BRIEF DESCRIPTION OF THE DRAWINGS

A description of the preferred embodiment of the invention is disclosed herein, and with reference to the drawings, in which:

FIG. 1 shows a pictorial view of the invention;

FIG. 2 illustrates the flow control valve in cross section view; and

FIG. 3 illustrates the fogging chamber of the invention in cross section view.

DESCRIPTION OF THE PREFERRED EMBODIMENT

Referring first to FIG. 1, the invention is shown in pictorial view. A container 10 for holding a supply of coating material, preferably a 55 gallon drum, has mounted thereon an air-actuated motor 12 connected to a reciprocating pump 14, which projects into the liquid coating material in the container. The pump delivers liquid coating material through hose 16 to an actuating gun 18. Gun 18 has a trigger 20 which controls an internal needle valve to selectively release the fluid into barrel 22. Barrel 22 is connected by means of a suitable fitting to fogger nozzle 25, which in turn is connected by means of a fitting to an elongated hollow wand 26 which has slots 28 near its extreme end. An air hose coupling 24 is connected into fogger nozzle 25, and coupling 24 connects an air hose 32 to the fogger nozzle 25. The other end of air hose 32 is connected to control valve 30 at coupling 33. A source of pressurized air is connected to air hose 35 which in turn is connected to control valve 30. A second source of pressurized air is connected to air hose 37 which connects to control valve coupling 38. Finally, an air hose 40 connects between control valve 30 and air motor 12. Air motor 12 and pump 14 may be any of a number of commercially available devices suitable for pumping fluids, as for example, Model 206–700, manufactured by the assignee of the present invention.

In operation, pressurized air enters control valve 30 through hose 35 and passes through control valve 30 to hose 40. The flow rate of this air is monitored by control valve 30, and may be regulated by adjustment of flow restricting valve 31. Control valve 30 senses the air flow therethrough and activates an internal valve section to permit pressurized air to flow out hose 32 to fogging chamber 25. The air flow through hose 40 activates air motor 12 to pump coating liquid through hose 16, and the air flow through hose 32 provides atomizing and conveying air to the fogging chamber 25. Thus, when trigger 20 is squeezed, pressurized coating liquid is sprayed into fogging chamber 25 and atomized by means of its air inlet 24, and the resultant fluid fog is conveyed through wand 26 and slots 28.

FIG. 2 illustrates the flow control valve in cross section, and shows the respective connections between the flow control valve and the remaining components of the invention. Control valve 30 has an inlet 50 and an outlet 52, with an intermediate flow restricting valve 31. Valve 31 is preferably a rotatable plug valve which may be adjusted to selectively restrict flow therethrough and to thereby create an adjustable air pressure drop between inlet 50 and outlet 52. The first passage 56 couples the air pressure upstream of flow restricting valve 31 into a diaphragm chamber 58. A second passage 62 couples the air pressure downstream from flow restricting valve 31 into a second diaphragm chamber 64. Diaphragm chambers 58 and 64 are separated by means of a flexible diaphragm member 60, which yields in response to a pressure differential across it to move either upwardly or downwardly. A valve stem 42 is activated by diaphragm 60 to translate the diaphragm motion to a linear valve stem motion. Valve stem 42 is connected to a poppet valve 45 which may be raised or lowered against its seat responsive to motion of valve stem 42, but having a net downward bias force provided by spring 44. Valve 45 is in opening and closing relationship between a valve inlet 48 and a valve outlet 49.

When the differential pressure across diaphragm 60 is such as to cause the diaphragm to deflect upwardly, the upward diaphragm motion is translated via valve stem 42 to lift valve 45 off its seat. This then permits pressurized air at inlet 48 to pass through to outlet 49. Since inlet 48 is coupled via air line 37 to a source of pressurized air, the opening of valve 45 permits pressurized air to flow through the valve to fogger nozzle 25. When the differential air pressure across diaphragm 60 reduces, so as to cause the diaphragm to deflect downwardly, this downward motion is translated via valve stem 42 to close valve 45. Valve closure is assisted by means of compression spring 44. Whenever the pressure differential across diaphragm 60 is zero, i.e., there is no pressure drop across flow restricting valve 31, diaphragm 60 will neither deflect upwardly nor downwardly. Valve stem 42 will therefore have no translational motion, and compression spring 44 will bias valve 45 into a closed position. Thus, in the absence of air flow through valve 30 and across valve restriction 31, air flow between inlet 48 and outlet 49 is shut off.

When trigger 20 on gun 18 is squeezed, an internal fluid valve enables pressurized liquid to flow through hose 16 from pump 14. This causes the liquid pressure to drop and relieves the pump back pressure sensed by air motor 12. Whenever this back pressure drops below the level of air pressure in hose 40, the air motor again begins reciprocating and causes air to flow through hose 40. This creates air flow through control valve 30 and causes a pressure drop across flow restricting valve 31. The pressure drop across valve 31 is sensed by diaphragm 60 to cause valve 45 to deflect upwardly and to thereby open a passage between inlet 48 and outlet 49. Pressurized air then flows through the upper portion of control valve 30 into hose 32 and nozzle chamber 25. This air provides the atomizing and fogging force for the liquid released into chamber 25 by means of triggering the gun.

When trigger 20 is released, liquid being introduced into fogger nozzle 25 immediately ceases, although air flow into the fogger nozzle continues. The stopping of liquid flow quickly develops a back pressure in hose 16 and pump 14, which pressure is sensed by air motor 12 as a force in opposition to the air motor reciprocation. A back pressure quickly develops in air hose 40 which is sensed across flow restricting valve 31 as a diminished flow through the valve. Pressure drop across diaphragm 60 equalizes and valve 45 is forced into a closed position. This shuts off any further air flow into fogger nozzle 25 and the gun terminates its fogging operation. It is important to note, and one of the features of the present invention relates to the delayed action shutoff of fogging air into fogger nozzle 25 after trigger 20 has been released to shut off the further flow of liquid into the fogger nozzle. This delayed action results in a cleaning and purging supply of pressurized air to be coupled into the fogger nozzle and wand 26. This supplementary air supply continues for a few seconds after the spray liquid has been turned off and therefore assists in the cleaning of the internal spray and fogging passages.

FIG. 3 shows a side cross sectional view of fogger nozzle 25. A pressurized liquid inlet 70 is connected to gun barrel 22 to provide an inlet flow path for coating liquid. Inlet 70 is coupled via suitable passages to a spray tip 72, which may be of conventional design. The assignee of the present invention and numerous other manufacturers sell paint spray tips which may be used with the present invention. These spray tips are characterized in that they generally have small elliptical orifices through which pressurized liquid may be ejected, and which cause a fine spray pattern to be formed just outside and downstream of the spray orifice. A pressurized air inlet 74 is provided proximate the downstream point where the liquid spray pattern is developed, and pressurized air entering through this inlet interacts with the spray pattern to create a fog consisting of fine particles of the coating liquid. This fog is expelled through outlet 76, which has a suitable connection for connecting to wand 26 and for propagating the fogged liquid out through the slots 28. As hereinbefore described, the sequence of operation of the invention causes the pressurized liquid into inlet 70 to be shut off prior to the flow of pressurized air into inlet 74. This enables pressurized air to flow into fogging chamber 68 and through outlet 76 after the liquid spray ceases, and serves to purge the fogging chamber and downstream passages from accumulations of liquid. It is preferable to include a one-way check valve ahead of air inlet 74, which valve permits the free flow of air therethrough but inhibits the reverse flow of coating liquid. This check valve prevents coating liquid from flowing through the system air lines in the event slots 28 in wand 26 become plugged or clogged.

Variations to the preferred embodiment disclosed herein may be made to the invention. For example, an elongated hose may be used in place of wand 26 to provide a flexible member for giving access to interior recesses. Similarily, a hydraulic-fluid driven motor may be used to provide the source of pressurized fluid for the invention, and in this case line 35 is connected to an external source of pressurized hydraulic fluid rather than to a source of pressurized air.

What is claimed is:

1. A fog/spray system actuable from a source of pressurized fluid for pumping liquid coating material from a container and delivering same through a trigger-actuable fog/spray applicator, comprising:

a. a fluid-operated pumping means, connected to said applicator and to said coating material container, for pumping said liquid coating material under pressure to said applicator, and wherein said applicator further comprises an internal passage therethrough for passing said coating material and an interior valve having a passage opening and closing position and actuable by said trigger;

b. a fluid control valve having a first valve passage connected between said fluid-operated pumping means and said source of pressurized fluid, said first valve passage having a flow restriction and a diaphragm chamber and diaphragm, with respective sides of said diaphragm being vented upstream and downstream of said flow restriction, and said fluid control valve having a second valve passage with an inlet for pressurized air and an outlet, and a movable valve member in said second valve passage connected to said diaphragm; and c. a fogging chamber having a first inlet connected to said applicator and a second inlet connected to said fluid control valve second passage outlet, and having an outlet for delivering said fog/spray liquid coating material.

2. The apparatus of claim 1, wherein said movable valve member in said second valve passage further comprises a valve stem actuated by said diaphragm.

3. The apparatus of claim 2, wherein said control valve second valve passage movable valve member further comprises a slide valve connected to said valve stem.

4. The apparatus of claim 3, wherein said fogging chamber further comprises a first and second inlet positioned in mutually transverse directions.

5. The apparatus of claim 4, wherein said applicator further comprises an outlet having a spray orifice forming a part thereof.

6. A fogging and spraying apparatus for applying a liquid fog coating material to surfaces from a liquid coating material container and under the influence of a pressurized air supply source, comprising:

a. an air flow responsive member connected to said pressurized air supply source, said member having means for sensing air flow from said supply, including a first air passage having an adjustable flow restricting member therein;

b. a reciprocable air motor connected to said air flow responsive member;

c. a reciprocable pump in said liquid coating material container, and connected to said reciprocable air motor;

d. a trigger actuable gun connected to said reciprocable pump for receiving pumped liquid coating material therefrom, said gun having a liquid spray outlet port;

e. a fogging chamber connected to said liquid spray outlet port, and having a transverse inlet port and a fogging outlet port;

f. an air valve connected to said pressurized air supply source and to said fogging chamber transverse inlet port, said air valve having a flow actuation member connected to said means for sensing air flow on said air flow responsive member; and g. an elongated hollow applicator connected to said fogging chamber fogging outlet port.

7. The apparatus of claim 6, wherein said air flow responsive member means for sensing air flow further comprises a chamber having a movable diaphragm therein, creating two chamber halves, and a first sensing passage coupling one chamber half to said first air passage upstream of said adjustable flow restricting member, and a second sensing passage coupling the other half to said first air passage downstream of said adjustable flow restricting member.

8. The apparatus of claim 7, wherein said air valve flow-actuation member further comprises a slidable stem contacting said diaphragm, and a slide valve attached to said stem and slidable opening and closing relationship to said pressurized air supply source connection.

9. The apparatus of claim 8, wherein said air valve flow actuation member further comprises means for spring biasing said slide valve in closing relationship to said pressurized air supply source.

* * * * *